US007984679B1

(12) United States Patent
McFee

(10) Patent No.: US 7,984,679 B1
(45) Date of Patent: Jul. 26, 2011

(54) MULTIPLE TERRACED COLLAPSIBLE TABLE

(76) Inventor: Richard Alexander McFee, Malabar, FL (US)

( * ) Notice: Subject to any disclaimer, the term of this patent is extended or adjusted under 35 U.S.C. 154(b) by 449 days.

(21) Appl. No.: 12/156,703

(22) Filed: Jun. 4, 2008

Related U.S. Application Data

(60) Provisional application No. 60/933,699, filed on Jun. 7, 2007.

(51) Int. Cl.
*A47B 7/00* (2006.01)

(52) U.S. Cl. ..... 108/106; 108/96; 108/145

(58) Field of Classification Search ..... 108/144.11, 108/91, 96, 101, 104, 106, 145, 147.22
See application file for complete search history.

(56) References Cited

U.S. PATENT DOCUMENTS 1,221,646 A * 4/1917 Zimmermann ..... 108/96
1,951,619 A * 3/1934 MacDonald ..... 297/139
2,027,386 A * 1/1936 Krummer ..... 74/99 R
2,079,225 A * 5/1937 Sabaneeff ..... 312/271
3,951,079 A 4/1976 Tolleson
4,334,482 A * 6/1982 Bolduc ..... 108/95
4,746,022 A * 5/1988 Benham ..... 211/195
5,363,772 A * 11/1994 Adamidis ..... 108/66
5,570,795 A * 11/1996 Colgrove ..... 211/187
5,799,587 A * 9/1998 Branch ..... 108/66
6,085,670 A * 7/2000 Genov ..... 108/147
6,139,168 A * 10/2000 Gary et al. ..... 362/249.19
6,510,956 B2 * 1/2003 Therber ..... 211/205
7,124,694 B2 * 10/2006 Li ..... 108/50.12

* cited by examiner

*Primary Examiner* — Janet M Wilkens
*Assistant Examiner* — Dan Rohrhoff

(57) ABSTRACT

An improved table design, providing a simple, multiple terraced, multiple configuration, and fully collapsible display by means of simple mechanical adjustments to the table. The entire surface of the table is comprised of tabletops nested within tabletops, forming a contiguous unified horizontal tabletop surface. A means is provided for lifting each nested tabletop to a higher elevation, thus creating a terrace above the surface of the respective surrounding tabletop. Said means of lifting said nested tabletops having minimal downward protrusion from the horizontal plane of the bottom of the primary tabletop, whereby said table can be manufactured as a fully portable table if desired. Combinations of said nested tabletops and elevated tabletops at variable heights allow the user to create a multitude of possible configurations. An optional magnetically attractive material on, in, or near the vertical edge of each tabletop facilitates easy decoration of the table with magnetic items.

1 Claim, 16 Drawing Sheets

6
4
5

6
4
5
7

6
4
5

4
6
5

MULTIPLE TERRACED COLLAPSIBLE TABLE

CROSS-REFERENCE TO RELATED APPLICATIONS

This application claims the benefit of provisional patent application Ser. No. 60/933,699, filed 2007 Jun. 7 by the present inventor.

FEDERALLY SPONSORED RESEARCH

Not applicable

SEQUENCE LISTING OR PROGRAM

Not applicable

BACKGROUND

1. Field of Invention

This invention relates to tables, specifically to tables which can function as normal tables, with the added benefit of having a means of elevating one or more smaller tabletops nested in a table's surface to accommodate the aesthetic display of items placed upon said smaller tabletops.

2. Prior Art

The need for a simple way to display items is a common one. Parties and public events of all kinds often require an aesthetically pleasing elevated display to add dramatic effect. Homeowners, caterers, trade show vendors, and party planners are just a few examples of people who would benefit from a simple and portable solution to this challenge.

The typical solution to this challenge is to place one or more structurally sound boxes, stands, or other objects on a table's surface to create elevated display areas above the table's surface. However, this solution is usually an impractical one due to the difficulty in locating appropriate objects for use as an elevated display and the difficulty and lack of simplicity in storing and accessing said objects when needed.

Some tables have been designed with a central platform which can be raised using a central shaft and some form of mechanical lifting to elevate said platform. U.S. Pat. No. 1,221,646 to Zimmerman (1917) discloses a gaming table with a centrally located gaming platform which is elevated by use of a mechanical foot petal. U.S. Pat. No. 2,079,225 to Sabaneeff (1936) shows a concealed storage and/or bar area which mechanically lifts out of a large cylindrical base. Both Zimmerman's and Sabaneeff's tables are heavy, non-portable, and limited to one diameter of elevating platform at the table's center.

U.S. Pat. No. 4,334,482 to Bolduc (1982) discloses a round table with a mechanically elevated lazy suzan in the tabletop's center. Bolduc's table seems to be the most relevant prior art to the invention being disclosed in this application. As with Zimmerman's and Sabaneeff's tables, Buldoc's table is not portable and is limited to one diameter of elevating platform.

All three of the above prior art examples utilize large areas beneath the tabletop surface to conceal the lifting mechanisms or additional tabletop surfaces, greatly limiting the portability of the tables.

U.S. Pat. No. 3,951,079 to Tolleson (1976) discloses a multiple level terraced space saver display for placement on the surface of an existing table. Tolleson's space saver doesn't allow for the nesting of the surface levels to create one flat surface for use as a normal tabletop.

SUMMARY

The invention, an improved table, comprises a table with one or more additional tables nested within the table's unified horizontal tabletop surface. A means is provided to allow erection of said nested tables to a higher vertical position, thereby creating a smaller elevated tabletop display above and supported by the table it was nested within. Each individual tabletop can have additional height adjustability once elevated into the erect position. There are several different configurations based upon which tables are left in the nested position, which tables are erected, and the adjusted height of each erected table.

DRAWINGS—FIGURES

In the drawings, each embodiment has the same number with different alphabetic suffixes for each individual drawing encompassing the disclosure of said embodiment.

Figure 4:
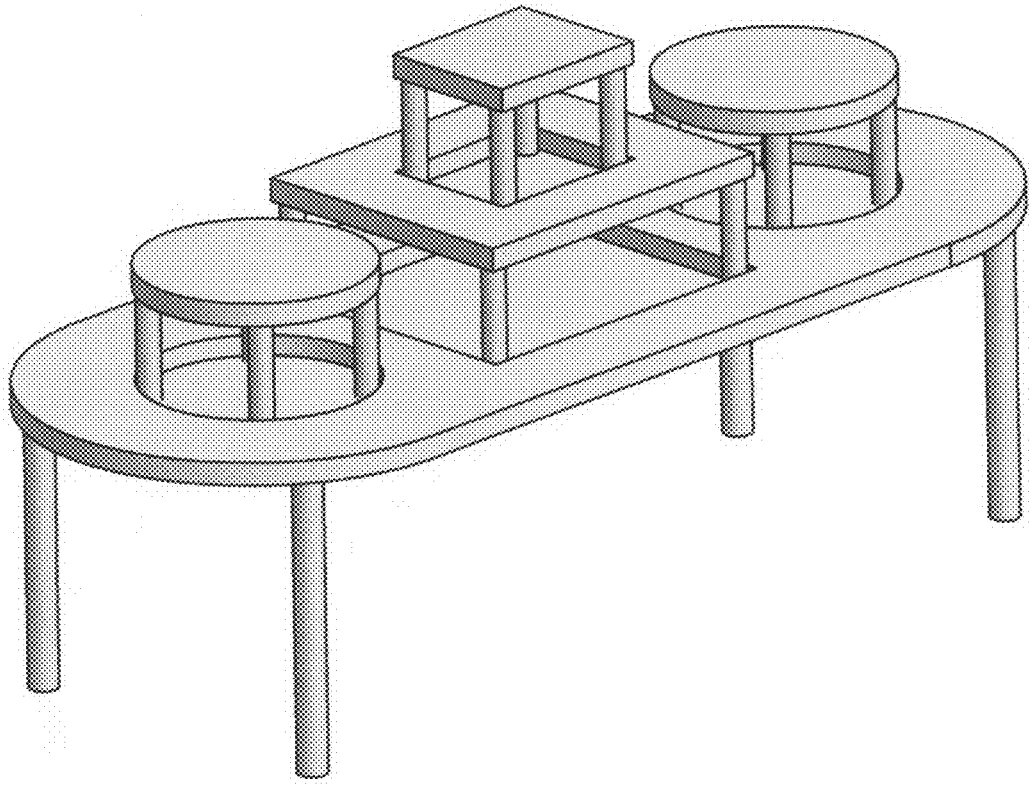

FIG. 4 demonstrates that the table is not strictly limited to a round shape and that the nested tables are not centrally constrained in all embodiments.

Figure 5A:
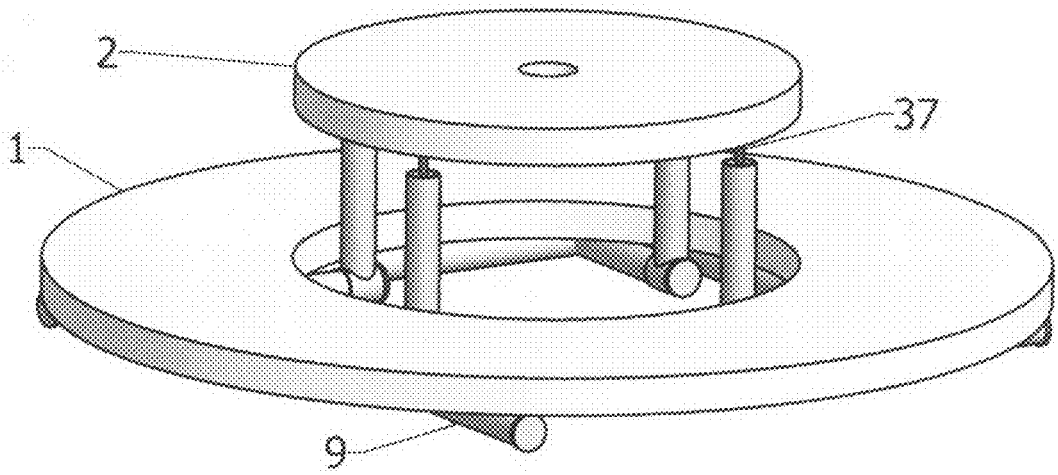
Figure 5B:
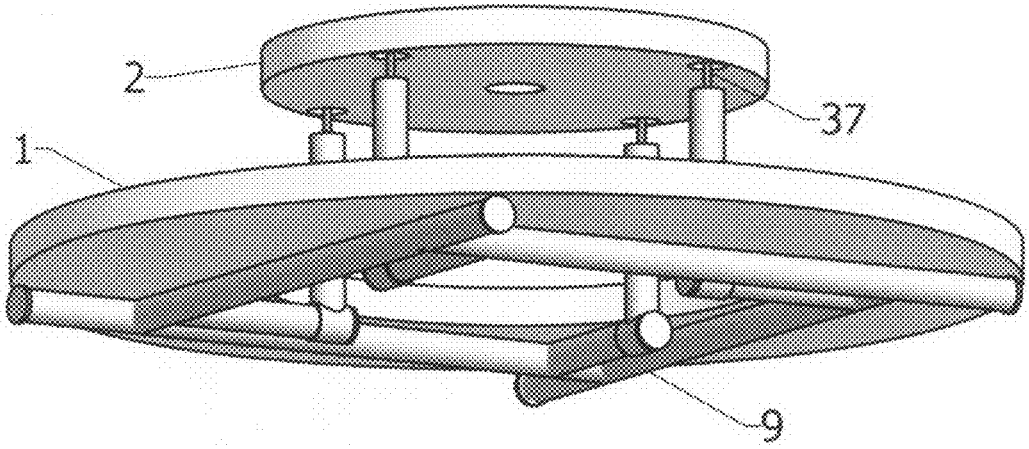

FIGS. 5A and 5B demonstrate an alternative leg mechanism design for the embodiment illustrated in FIGS. 1A to 1H.

REFERENCE NUMERALS—FIGS. 1 AND 5

| Reference Numerals - FIGS. 1 and 5 | | | |
|---|---|---|---|
| 1 | secondary tabletop | 2 | central tabletop |
| 3 | folding table leg | 4 | outer lift mechanism leg |
| 5 | inner lift mechanism leg | 6 | pivotal locking upper leg attachment |
| 7 | lift mechanism (combination of 4, 5, and 6) | 8 | mechanism spring |
| 9 | structural reinforcing framework | 10 | central lifting hole |
| Reference Numerals - FIG. 2 | | | |
| 11 | central support shaft | 12 | secondary support shaft |
| 13 | third support shaft | 14 | outer support shaft |
| 15 | central tabletop securing nut | 16 | central tabletop |
| 17 | secondary tabletop | 18 | table base |
| 19 | top end cap | 20 | bottom end cap |
| 21 | central support shaft through bolt | | |
| Reference Numerals - FIG. 3 | | | |
| 31 | small central tabletop | 32 | medium secondary tabletop |
| 33 | large outer tabletop | 34 | central table folding legs |
| 35 | secondary table folding legs | 36 | main table legs |
| Reference Numerals - FIG. 5 | | | |
| 37 | elastic cord | | |

DETAILED DESCRIPTION

All Figs—All Embodiments

In all embodiments, the preferred material for tabletops is blow-molded plastic. The preferred structural reinforcing framework for said tabletops is any metal which proves to be structurally and economically viable. However, the table can consist of any materials which prove to be structurally viable and can withstand the stresses of normal use.

Figure 1A:
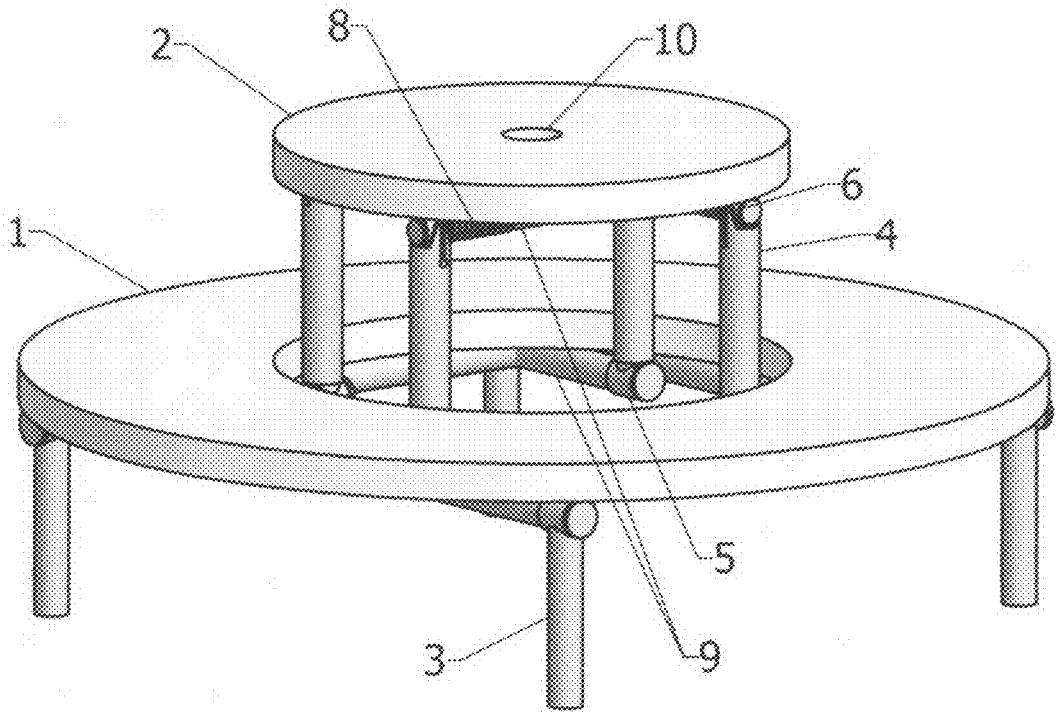
FIGS. 1A to 1I show various aspects of the design and functionality of the nesting folding table leg mechanisms in accordance with one embodiment.
Figure 1B:
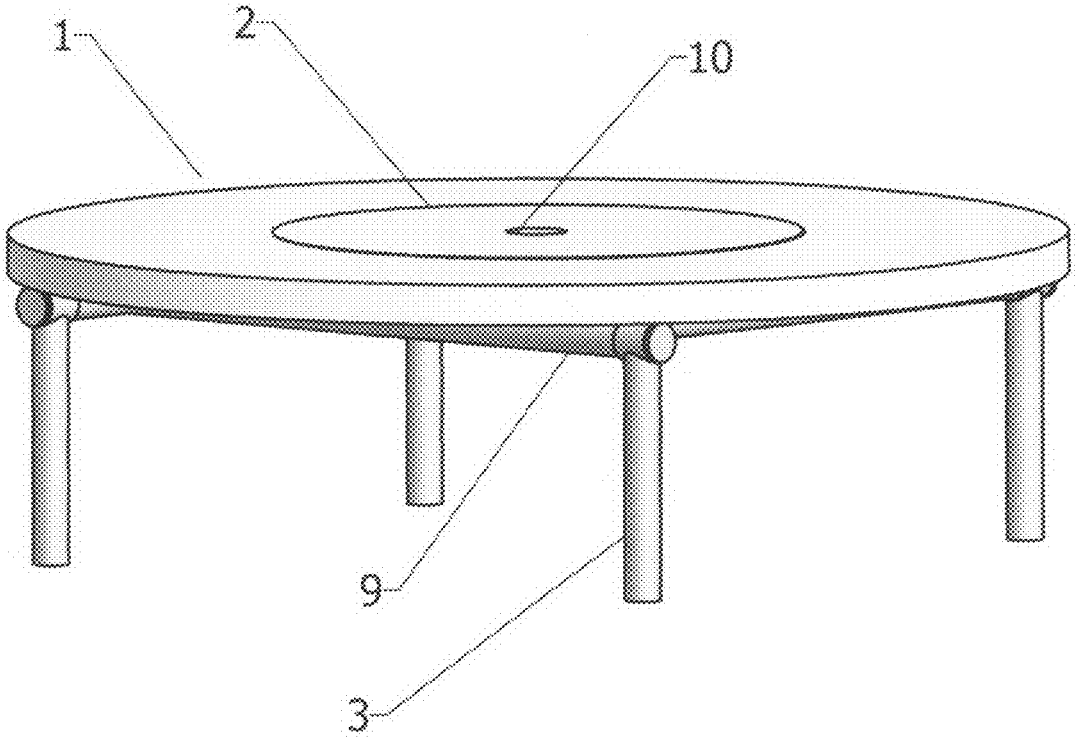

All embodiments can contain a plurality of nested tabletops and host tabletops. A host tabletop is defined here as any tabletop containing a smaller nested tabletop within its tabletop surface. A nested tabletop is defined here as any tabletop which is nested within a larger tabletop's surface. In all cases, the nested and host tabletops combine to create a unified horizontal tabletop surface when the nested tabletop is in the nested position. For visual reference, the central tabletop 2 of FIGS. 1A and 1B is a nested tabletop and the secondary tabletop 1 is its host tabletop. The table can also include one or more additional progressively larger surrounding tabletops, whereby the secondary tabletop 1 would act as host tabletop to the central tabletop 2, but also as a nested tabletop to the next progressively larger surrounding tabletop. Said next progressively larger surrounding tabletop would thereby act as host tabletop to the secondary tabletop 1. The same nested tabletop and host tabletop relationship repeats outwardly until the largest tabletop is reached.

Each tabletop may also contain a magnetically attractive band around its vertical outer perimeter to accommodate magnetic decorations or table skirting and also assist in magnetically holding each level in the nested position.

FIGS. 1A to 1I—Embodiment 1

One embodiment of the table is illustrated in FIG. 1A (erected position) and 1B (nested position). The complete table's surface consists of a central tabletop 2 and a secondary tabletop 1. Each nested tabletop will use the same means of erection demonstrated in FIGS. 1A to 1I.

The folding table legs 3 are the main means of supporting the complete table and will only be present beneath the largest tabletop. These folding table legs 3 can be manufactured in accordance with manufacturing processes currently used in the manufacture of folding tables.

A plurality of lift mechanisms 7 is the means for erecting each nested tabletop level above its respective host tabletop in this embodiment. A lift mechanism 7 consists of an outer lift mechanism leg 4, an inner lift mechanism leg 5, and a pivotal locking upper leg attachment 6. The horizontal cylindrical opening of the pivotal upper leg attachment 6 pivotally connects to the structural framework 9 of the nested tabletop, and the horizontal cylindrical opening of the inner lift mechanism leg 5 connects to the structural framework 9 of said nested tabletop's surrounding host tabletop.

In FIGS. 1C to 1I, some or all of the structural framework 9, the central tabletop 2, and the secondary tabletop 1 have been omitted to assist in a clear disclosure of the mechanical operation of the lift mechanism 7. However, it is easy for the reader to understand where and how the horizontal cylindrical openings of both the pivotal upper leg attachment 6 and the inner lift mechanism leg 5 pivotally connect to the structural framework 9 by observing said pivotal connections in FIG. 1A.

FIGS. 1C to 1F provide a clear illustration of some of the varying positions of the effected lift mechanisms 7 as a nested tabletop is being elevated into an erect position or collapsed into a nested position.

Figures 1C, 1D, 1E, 1F:
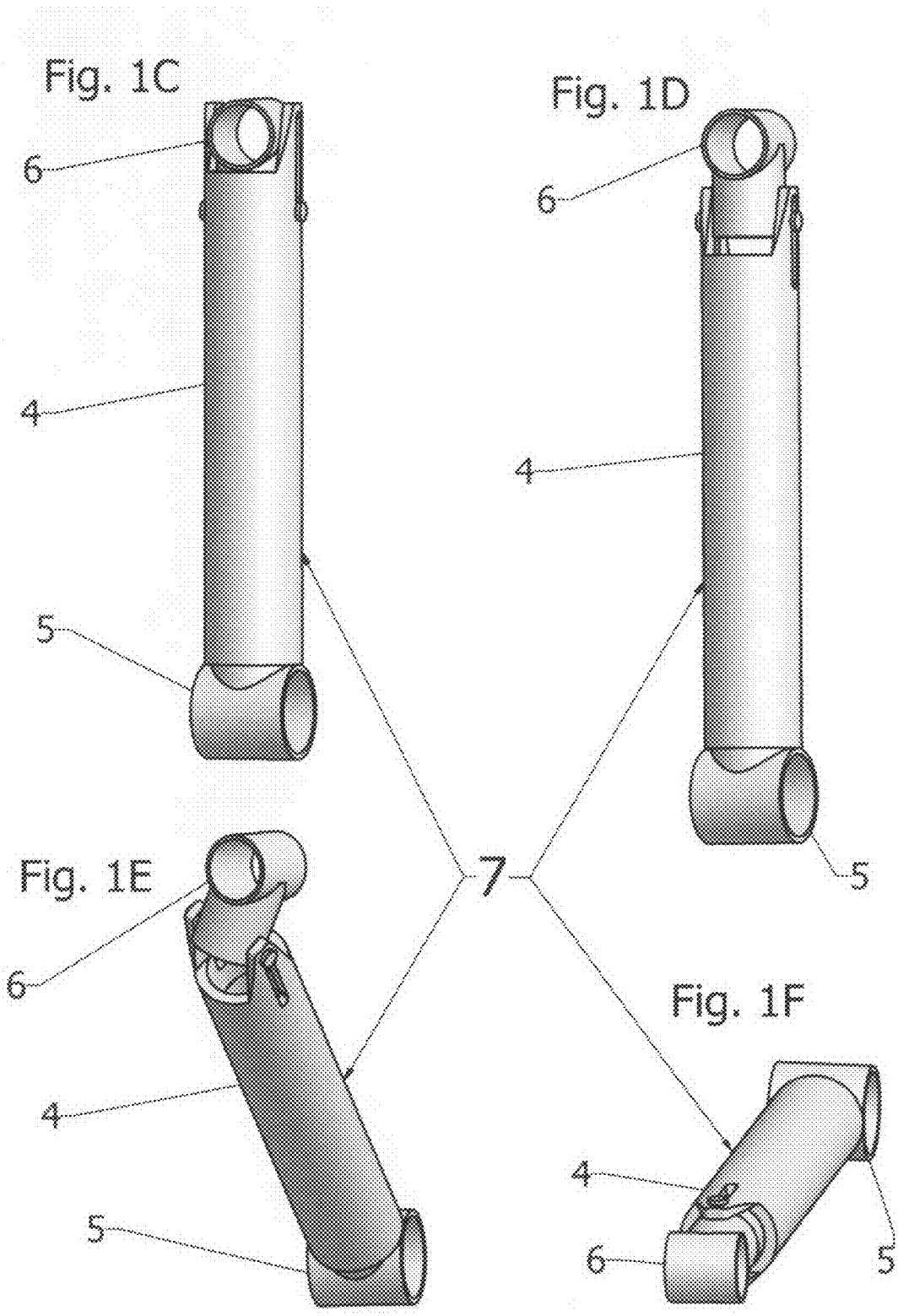

In FIG. 1C, the lift mechanism 7 is shown in the erected and locked position. Note that the pivotal locking upper leg attachment 6 is slidably and gravitationally inserted into the into the outer lift mechanism leg 4, disabling the pivotal motion of the pivotal upper leg attachment 6 on the axis of its sliding pin. When all lift mechanisms 7 located beneath an erected tabletop are positioned in accordance with FIG. 1C, the erected tabletop is securely locked in the upright position.

FIG. 1D shows the pivotal upper leg attachment 6 slidably lifted into the unlocked position by means of manual lifting of the tabletop and thus the structural framework and the pivotal locking upper leg attachment 6. This enables the pivotal motion of the pivotal upper leg attachment 6.

Figure 1G:
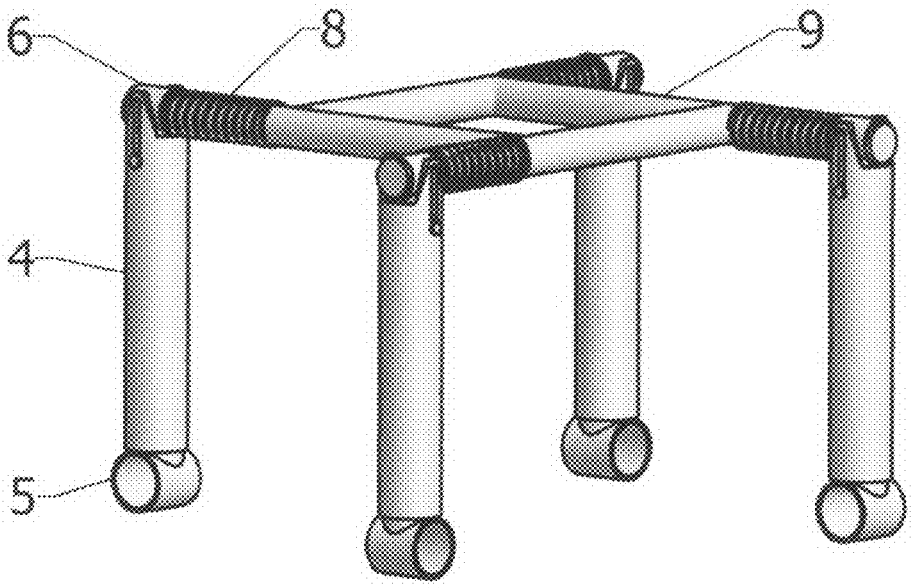
Figure 1H:
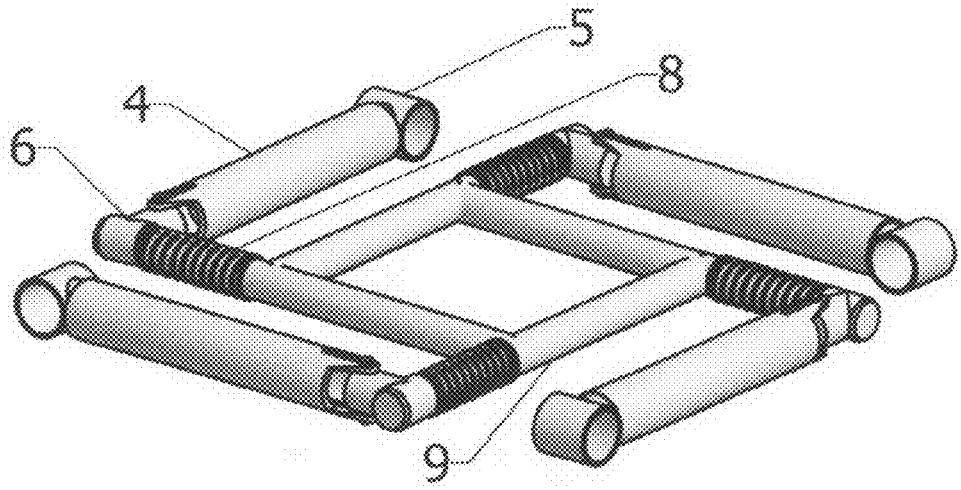
Figure 1I:
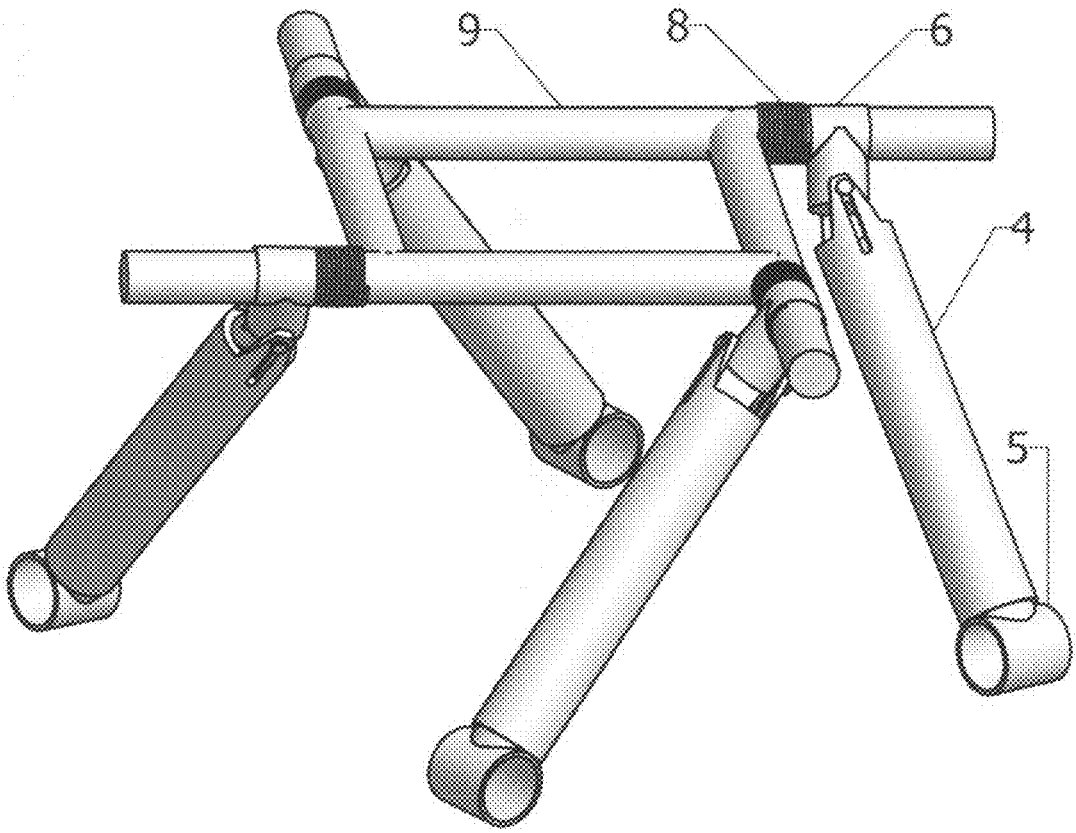

FIGS. 1E and 1I demonstrate how said pivotal motion, combined with the pivotal and slidable motion of the lift mechanism's 7 connections to the structural reinforcing framework 9, and the rotational motion of the outer lift mechanism leg 4 around the inner lift mechanism leg 5, are an effective means of erecting and nesting the tabletops while maintaining a physical connection to the structural framework 9 of both the nested tabletop and the larger surrounding tabletop. In FIG. 1E, the erected tabletop is approximately halfway through the motion of either erection of the previously nested tabletop or nesting the previously fully erected tabletop.

FIG. 1F demonstrates the lift mechanism 7 in the fully nested position. In this position, the tabletop above the lift mechanism 7 is fully nested within the surrounding larger tabletop and the two tabletops combine to create one horizontally flat tabletop surface.

FIG. 1G shows a clear view of the lift mechanisms 7 for the central tabletop 2 in the erected and gravitationally locked position. The mechanism spring 8 is in the fully uncompressed position.

FIG. 1H shows a clear view of the lift mechanisms 7 in the nested position.

FIG. 1I shows a clear view of the lift mechanisms 7 for the central tabletop 2 in the transitional position. In this example, the tabletop is approximately halfway through the motion of either erection of the previously nested tabletop, or nesting the previously fully erected tabletop. The mechanism spring 8 becomes fully compressed at this point by the pivotal locking upper leg attachment 6, which is slidably connected to the structural reinforcing framework 9. When a tabletop is in the fully erected or fully nested position, the pivotal locking upper leg attachment 6 returns to its normal horizontal position in relation to said tabletop's outer edge and the mechanism spring 8 returns to the fully uncompressed position.

FIGS. 2A to 2D—Embodiment 2

Figure 2A:
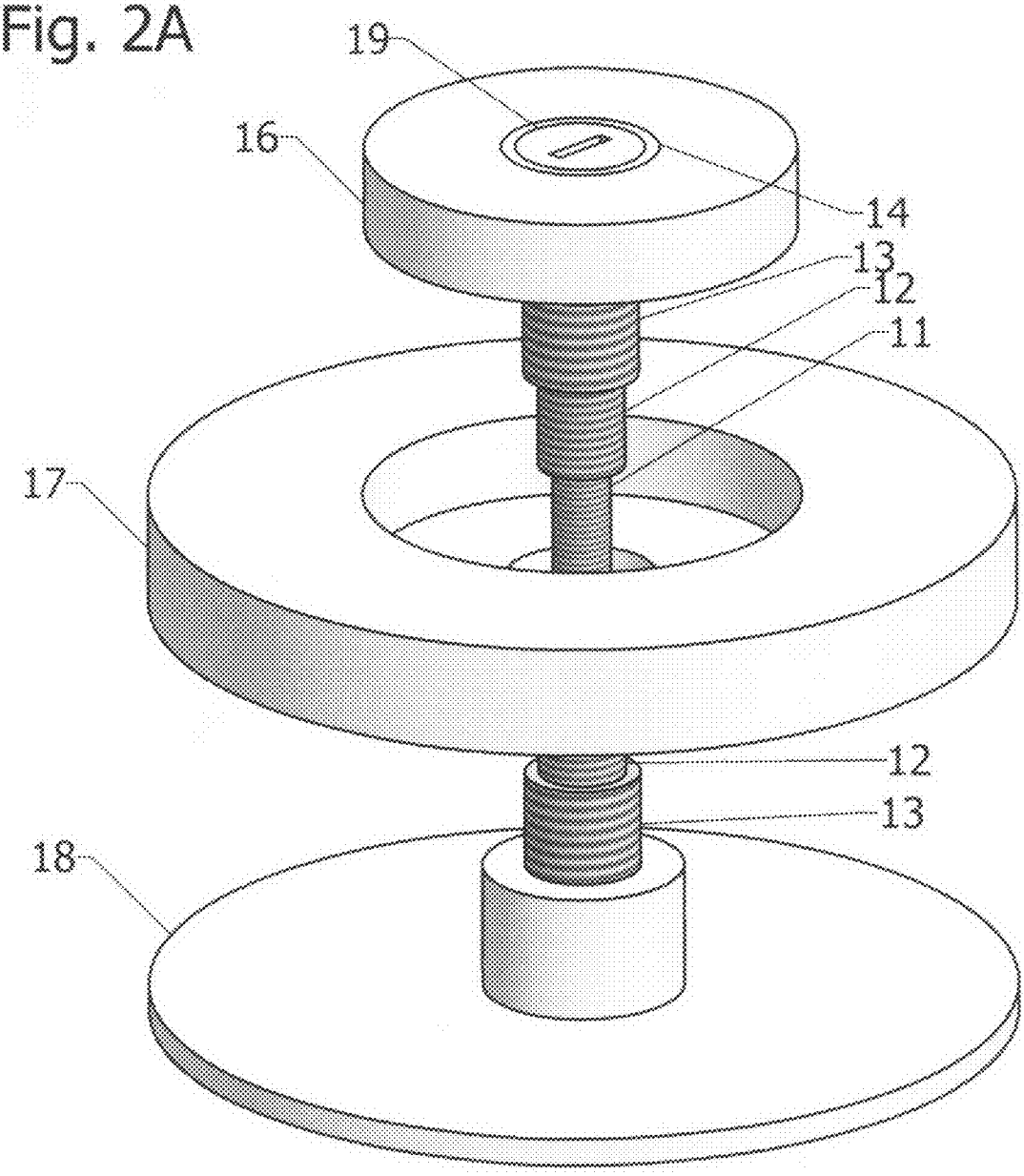
FIGS. 2A to 2D show an alternative embodiment based on the use of a threaded central support system.

FIG. 2A shows an alternative embodiment in the fully erected position. The use of multiple threaded support shafts 11/12/13/14 allows for erection and nesting of the central tabletop 16 and the vertical raising and lowering of the secondary tabletop 17.

Figure 2B:
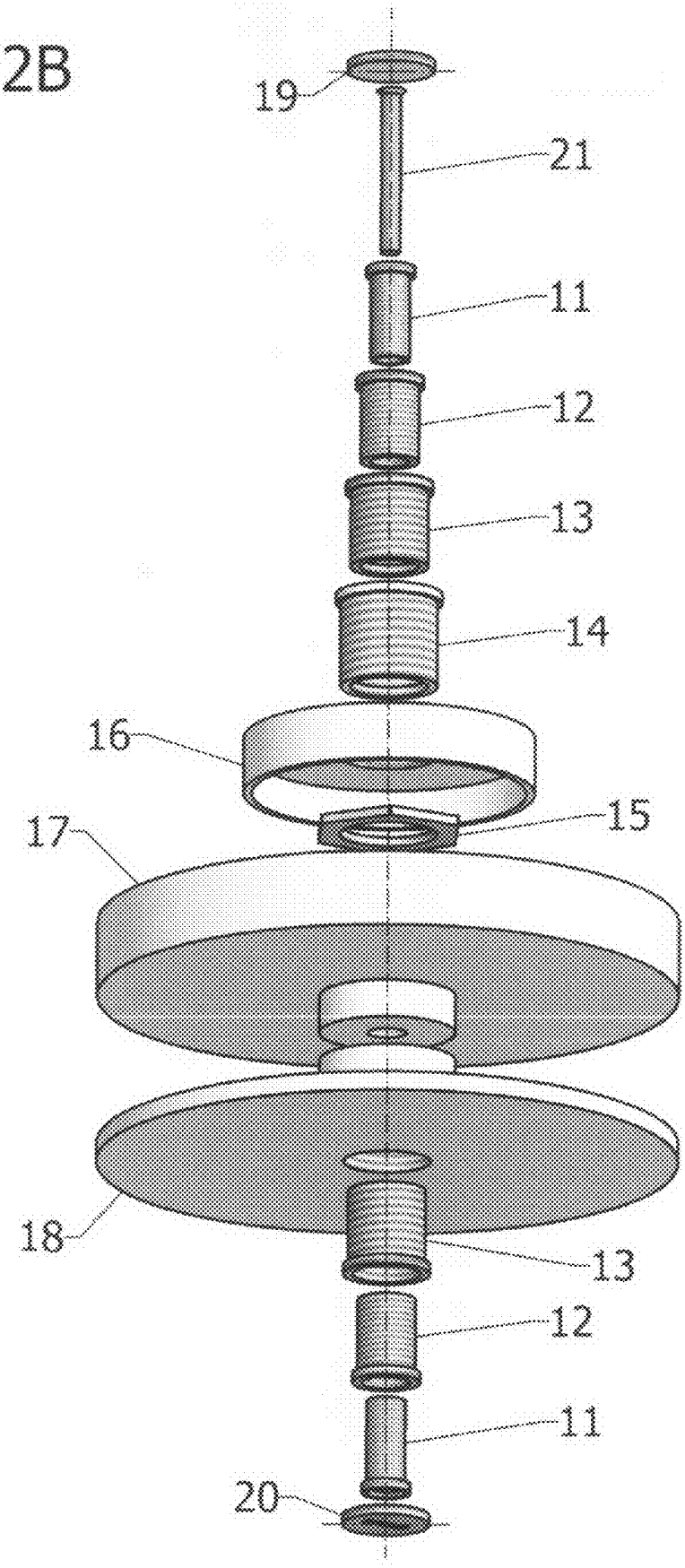

FIG. 2B shows an exploded view of all of the parts of this embodiment. The outer support shaft 14 is secured to the central tabletop 16 with the central tabletop securing nut. The third support shaft 13 is then threaded into the outer support shaft 14. Another third support shaft 13 is threaded into the table base 18. The secondary support shafts 12 are threaded into the third support shafts 13. The central support shafts 11 are threaded into the secondary support shafts 12 and into the secondary tabletop 17. The central support shaft through bolt is then threaded fully into the two central support shafts 11. The end caps 19/20 lock the support shafts and bolt 11/12/13/14/21 in the assembled position and can be easily removed to allow removal of parts for replacement.

The outer support shaft 14, the third support shaft 13, and the secondary support shaft 12 all have a female thread on the inside with a smaller female threaded lip at one end and a male thread on the outside with a larger male threaded lip at the opposite end from the female threaded lip. The central support shaft 11 is the same basic design, with the exclusion of the female threaded lip. This design facilitates the rotational height adjustment of both the central 16 and secondary 17 tabletops while also maintaining structural stability at all heights. The threaded lips on the support shafts 11/12/13/14 also provide a physical stop during tabletop elevation, preventing accidental disassembly by fully unthreading the support shafts.

Figure 2C:
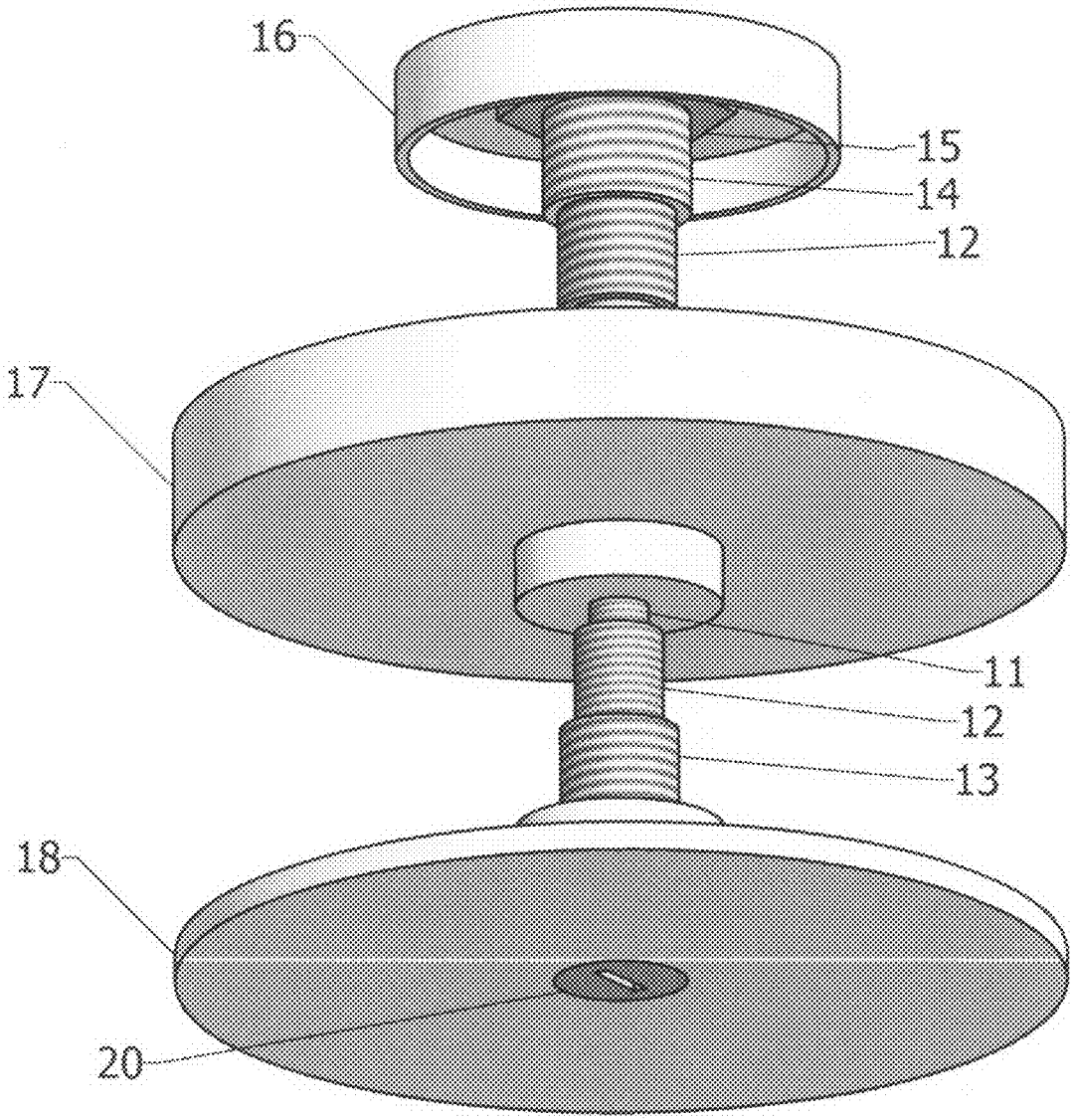

FIG. 2C is a bottom view of the table in the fully erected position

Figure 2D:
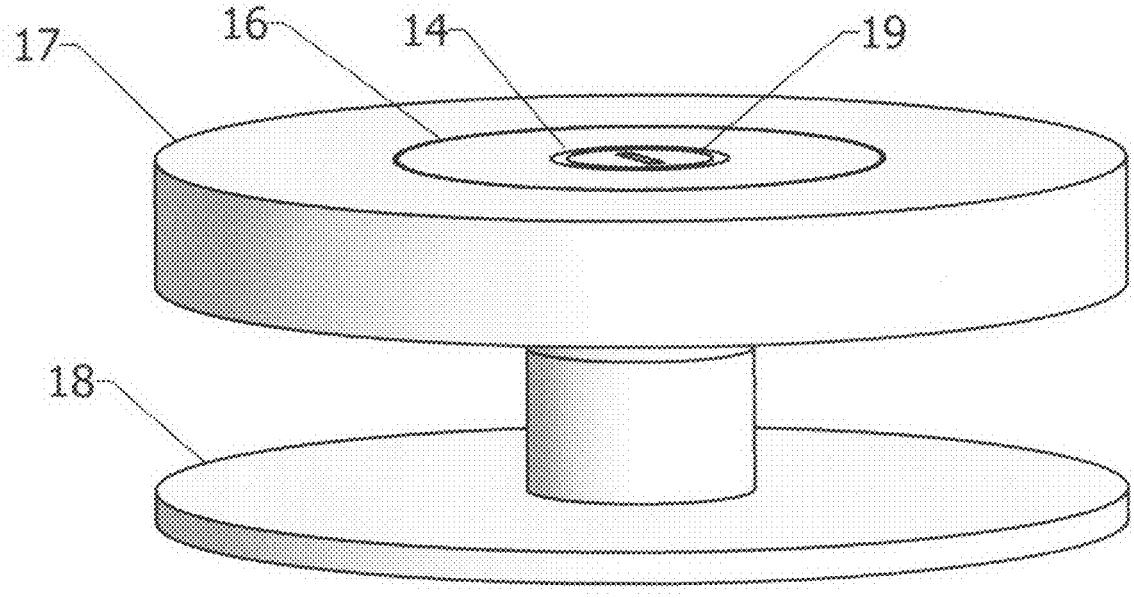

FIG. 2D is a view of the table in the fully collapsed position

FIGS. 3A to 3E—Embodiment 3

Figure 3A:
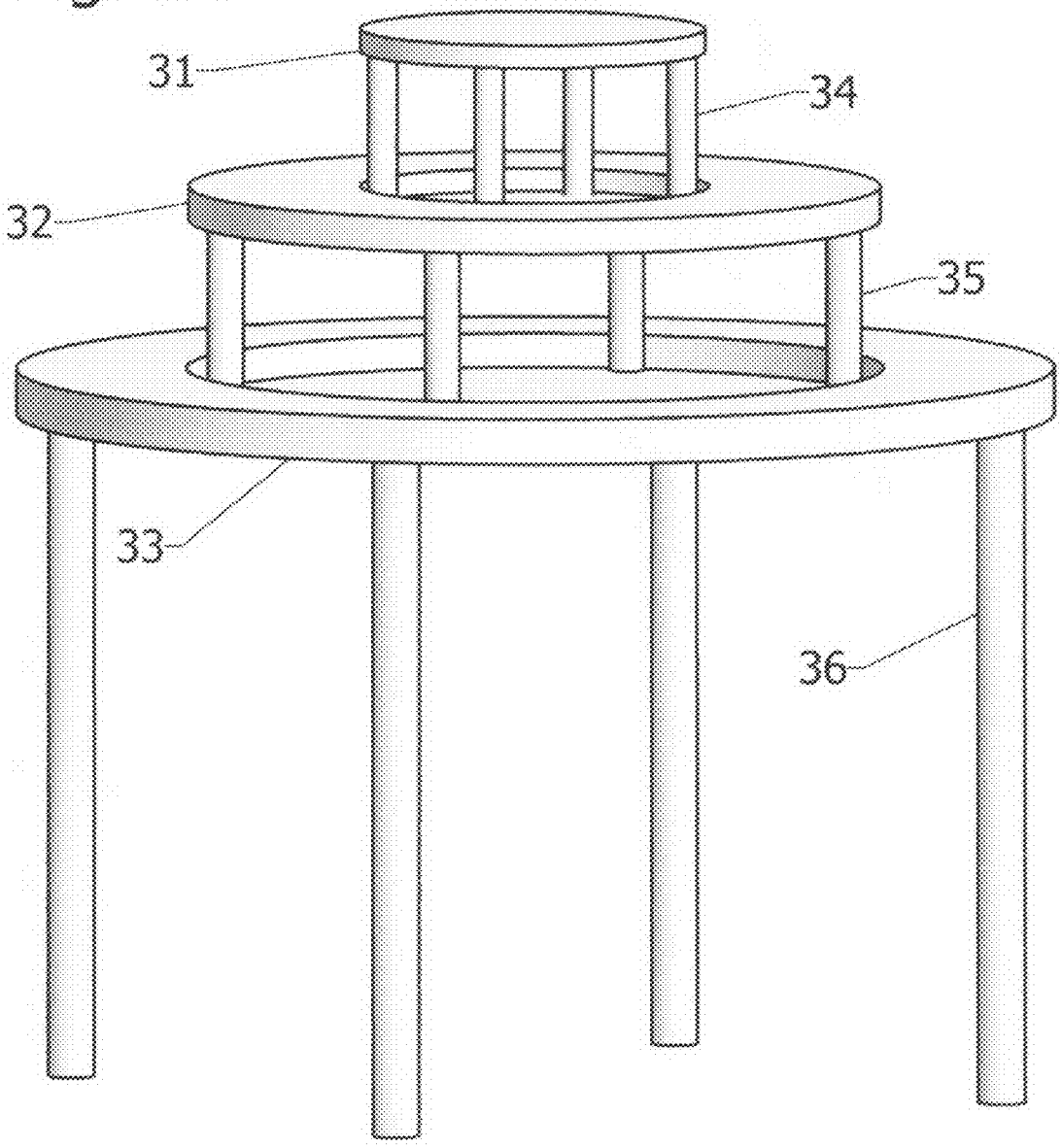
FIGS. 3A to 3E show an alternative embodiment based on nesting fully separate tables within each other.

FIG. 3A shows another alternative embodiment in the fully erected position. As with all embodiments, there is no set limit on the number of nested tabletop levels. In this embodiment, each of the tabletops function independently as a separate folding table or in combination as a unified horizontally level tabletop surface or a multitude of display configurations. The foldable table legs can all be manufactured using existing folding table leg technologies. Here you see the small central tabletop 31 with the central table folding legs 34 in the erected position. The central table folding legs 34 are resting upon a solid base in the tabletop nest area of the medium secondary tabletop 32. The secondary table folding legs 35 are also in the erected position and resting upon a solid base in the tabletop nest area of the large outer tabletop 33.

Figure 3B:
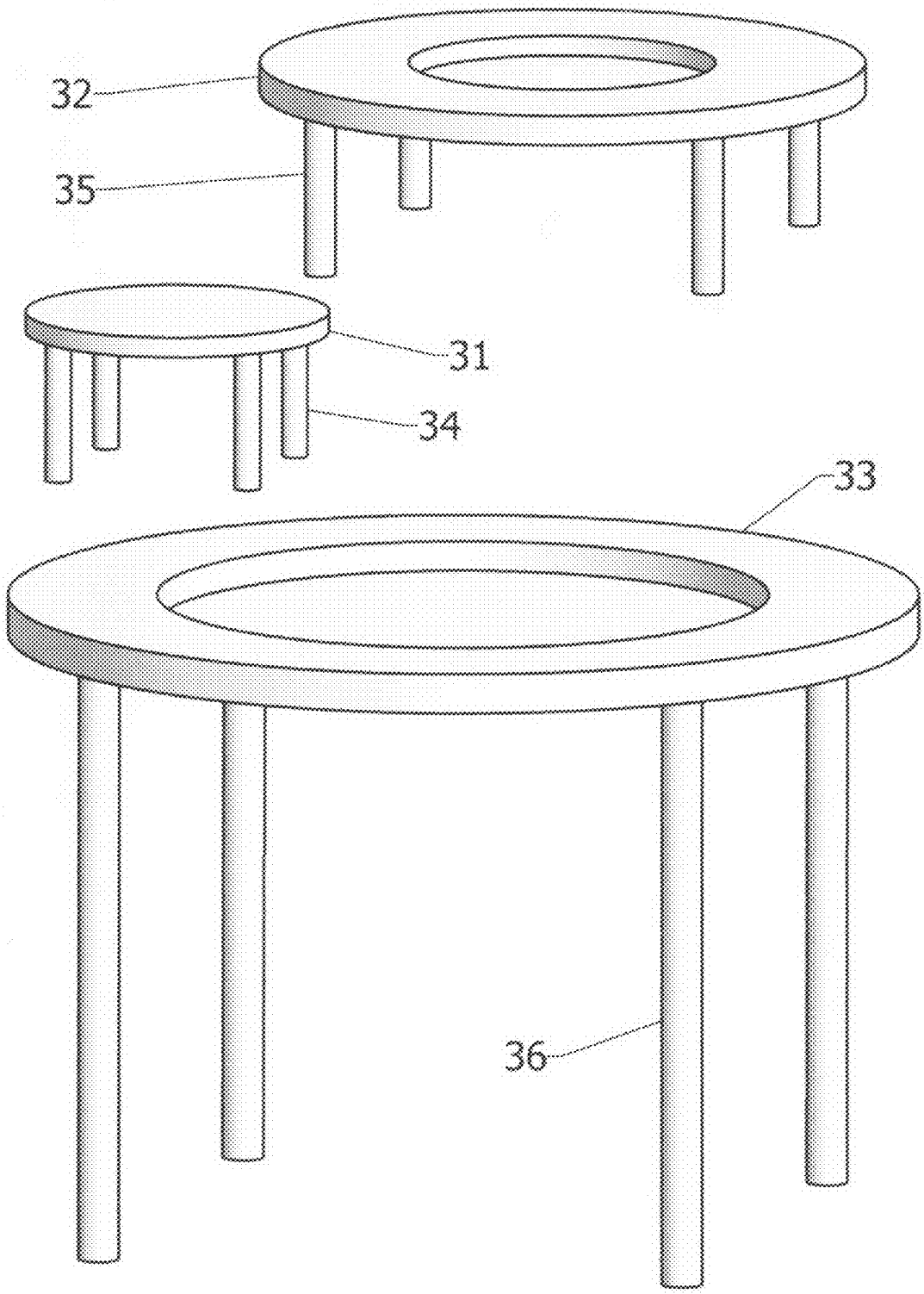

FIG. 3B shows the three independent tables physically separated for independent use or for access to the folding leg mechanisms when creating the erected display.

Figure 3C:
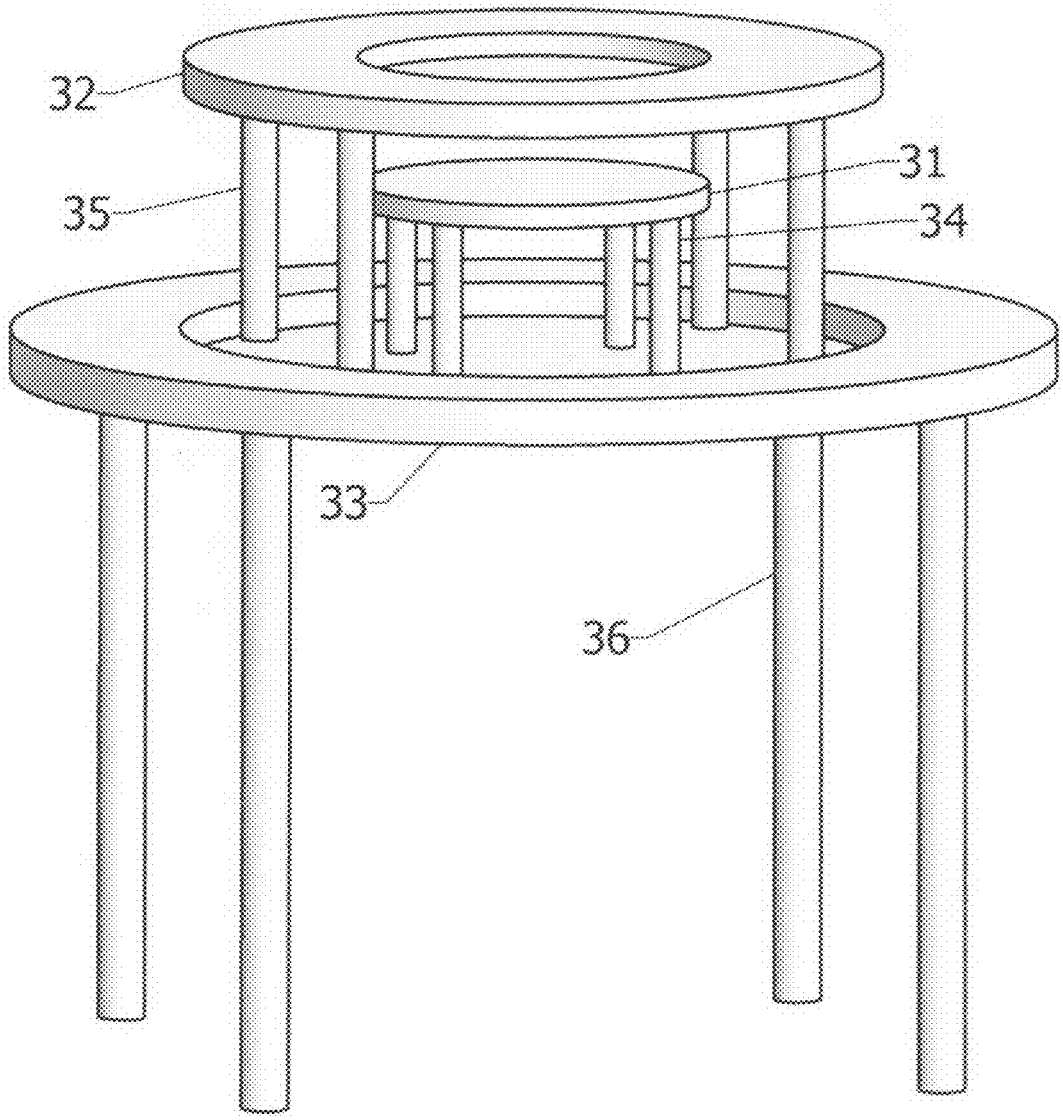
Figure 3D:
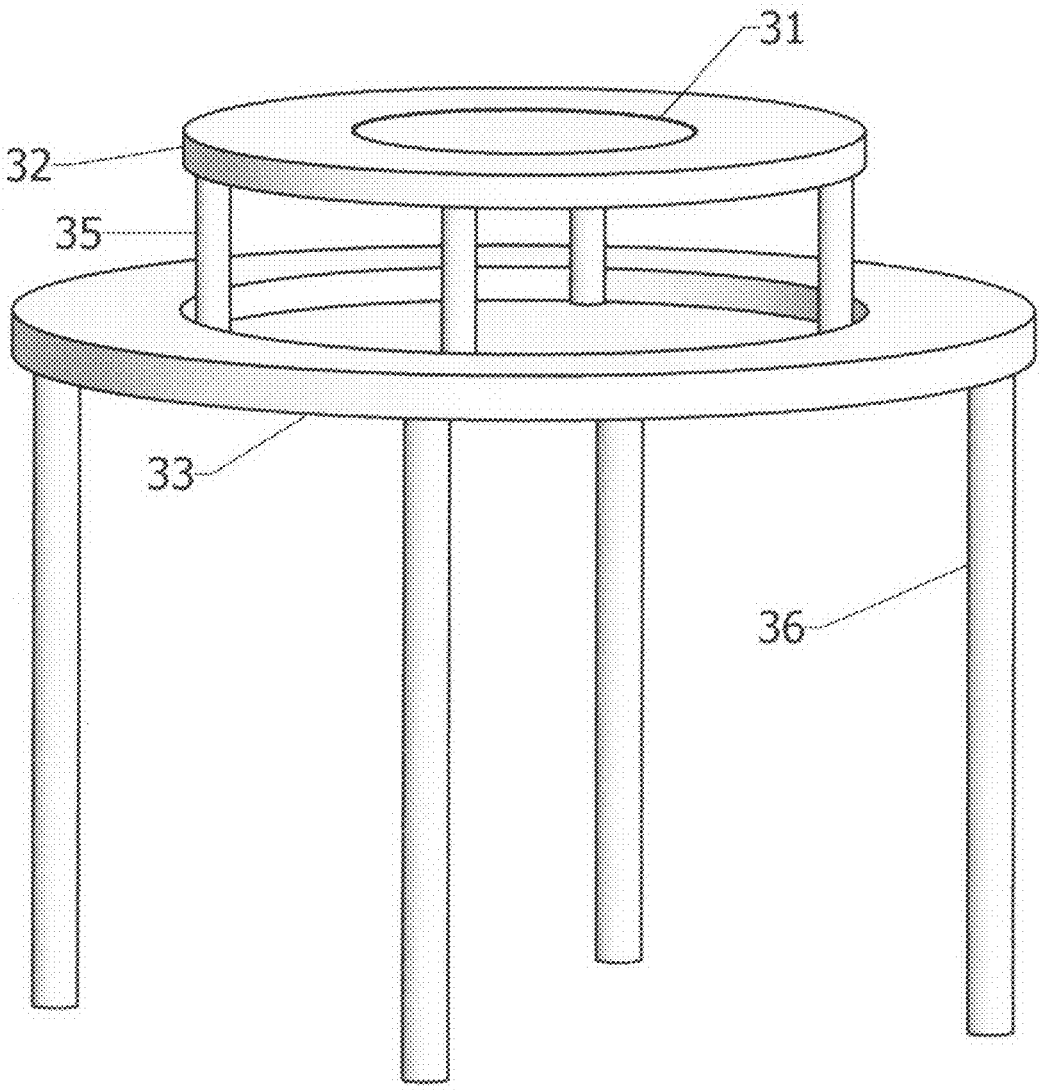

FIG. 3C demonstrates how this embodiment allows for a wider range of possible configurations FIG. 3D demonstrates a configuration in which the small central tabletop 31 is in the nested position within the medium secondary tabletop 32, combining the two said tabletops into one unified horizontal tabletop surface. The secondary table folding legs 35 are in the erected position. The result is a large terrace above and in the center of the large outer tabletop 33.

Figure 3E:
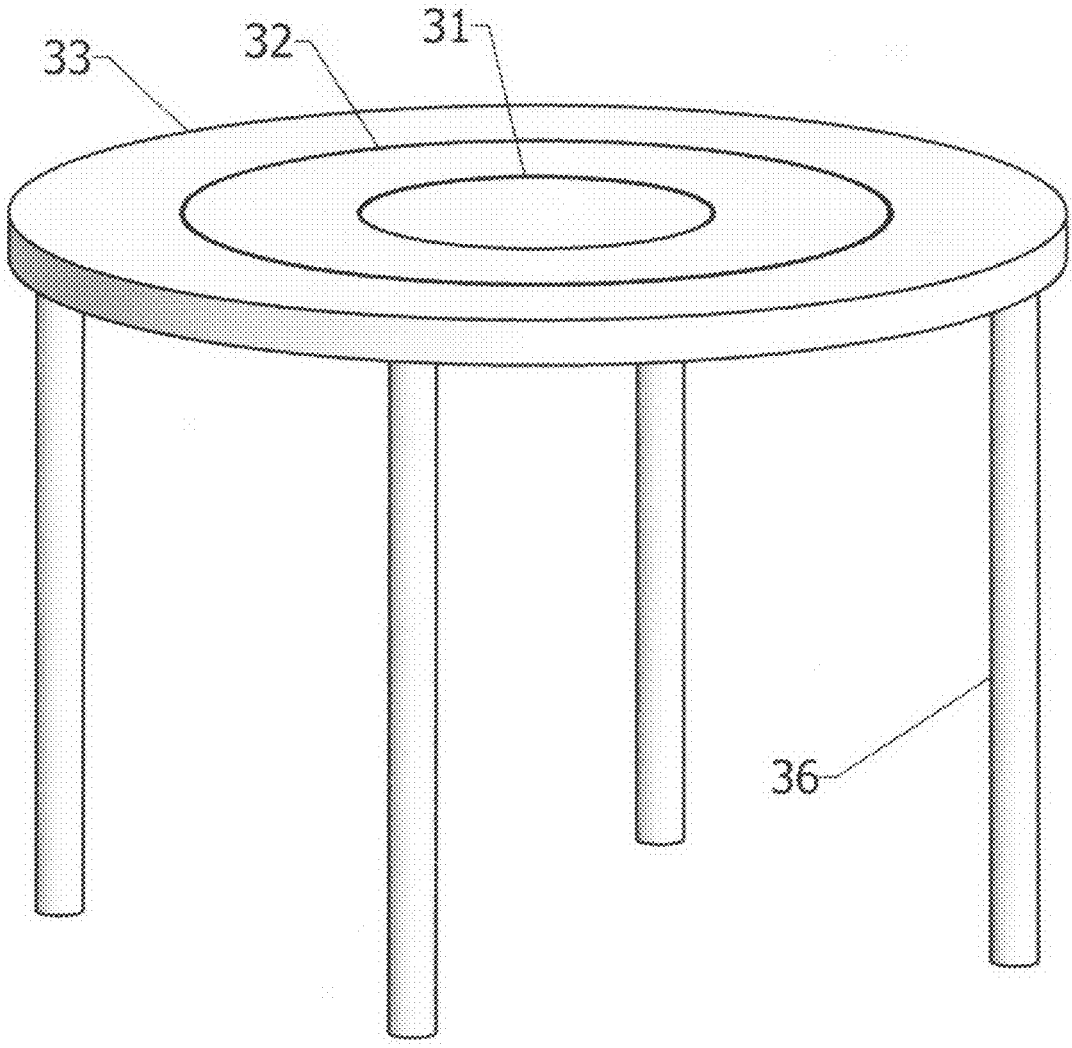

FIG. 3E demonstrates the table in the fully nested configuration.

FIG. 4

FIG. 4 simply demonstrates that the embodiment illustrated in FIG. 3 is not limited to a round shape or to any particular orientation of the main tabletop or the nested tabletops. Also, one table can comprise a plurality of tabletop shapes and sizes.

FIGS. 5A and 5B

FIGS. 5A and 5B simply demonstrate a simple alternative method for physical attachment of the central tabletop 2 to the folding leg mechanism connecting the central tabletop 2 and the secondary tabletop 1. This same alternative method could be implemented into any additional surrounding tabletop levels. This may be a simple and inexpensive alternative to the somewhat complex lift mechanism 7 disclosed in FIG. 1. The mechanism 7 has been replaced here by an elastic cord 37 to achieve the same basic function.

Operation—FIGS. 1 and 5

In operation one uses the table as a normal table. The user can, when desired, create one or more progressively smaller elevated tabletops above the surrounding tabletop surface. To do this, the user will insert one or more fingers into the central lifting hole 10 and lift the central tabletop 2 vertically while horizontally rotating the central tabletop 2 around the vertical axis of said central tabletop 2 a distance approximately equal to the length of the lift mechanism 7. Once the lift mechanisms 7 are in the erect position, the central tabletop will be vertically lowered straight down to a physical stop, thereby locking said lift mechanisms 7 into the erected position and securing the central tabletop 2 into the erected position. Each additional elevating tabletop will be erected above the next progressively larger surrounding tabletop by manually grasping two or more of the erect lift mechanisms 7 of the erected tabletop previously nested within the tabletop currently being erected, and lifting and rotating said additional elevating tabletop on its vertical axis a distance approximately equal to the length of the lift mechanisms 7. Again, lowering the tabletop vertically to a physical stop will thereby lock said lift mechanisms 7 and said additional elevating tabletop into the erected position. Collapsing each tabletop back into the original nested position is simply the reverse of erection. Nesting or erection of any tabletop (with the exception of the central tabletop 2) requires the erection of next progressively smaller tabletop nested within said tabletop. The lift mechanisms 7 beneath the next progressively smaller tabletop act as both structural support for said smaller tabletop and as lift points for the possible erection and nesting of the larger tabletop it is nested within.

FIG. 2—Alternative Embodiment

In operation, one uses the table as a normal table. The user can, when desired, erect each nested level of the tabletop by simply rotating the tabletop being erected in a counterclockwise motion around the vertical axis of the table. A plurality of threaded shafts 11/12/13/14 cause their combined length to increase as each progressively smaller shaft threads out of the larger shaft it is threaded into. This causes the tabletop being rotated to rise vertically into a multitude of possible heights relative to the tabletop it was previously nested within.

FIGS. 3 and 4—Alternative Embodiments

In operation, one uses the table as a normal table. When desired, the user can erect any nested table by lifting said nested table (including said nested table's folding table legs or other means of erection) out of the surrounding tabletop it is nested within, unfolding the legs of the table being erected, and placing erect table in the nesting location from which it was removed. The legs of the table being erected will then be resting upon the solid base of said nesting location. Any nested table can also be removed and used independently from the other elements of the table.

ADVANTAGES

From the description above, a number of advantages of the embodiments of my table become evident:

(a) The ability to collapse the combined tabletop surfaces into a unified horizontally flat tabletop surface allows the table to be used as a normal table.

(b) All embodiments easily transform into a simple, multiple configuration, multiple level terraced display by making quick and easy mechanical adjustments to the table.

(c) Boxes, stands, and other objects placed upon regular tables will no longer be required to create dramatic tabletop displays.

(d) The potential portability of the table makes it very easy to store and transport.

(e) Each tabletop level can be made independently height adjustable, increasing the number of possible configurations.

(f) In one embodiment (FIGS. 3 and 4) the ability to fully separate each tabletop as an independent table greatly increases the number of functional uses and configurations of the table, while decreasing any design restrictions based on the shape of the tabletop surface. This embodiment also permits the use of the nest area of a table for a multitude of additional purposes, such cold display of food and drinks with the addition of ice to said nest area. Said nest area could also be utilized as an easy access wash basin for bathing pets or babies, a small sandbox for a children's play area or a beach themed display, or even in conjunction with a smaller tabletop 31 and a water pump to create a small waterfall in the center of the main outer tabletop 33 (See FIG. 3C).

(g) The possible addition of a magnetically attractive band around the outer vertical perimeter of each tabletop surface will allow for easy decorating of the table's perimeter using magnetic decorations or table skirting. This same magnetic system can also be adapted for use as a magnetic system for holding the nested tabletops in the nested position during transport of the table.

CONCLUSION, RAMIFICATIONS, AND SCOPE

Accordingly, the reader will see that the multiple terraced collapsible tables of the various embodiments can be used as both a normal table and as a terraced display with multiple configurations.

This collapsible and portable table will greatly simplify the task of displaying gifts, products, food, beverages, plants, and anything else the user desires to display with dramatic effect.

The combination of all of the possible features: Collapsibility, portability, terraced display, height adjustability, multiple configurations and functions, and magnetic decoration all add up to a superior display table which is both simple and fun to use.

Although the description above contains many specificities, these should not be construed as limiting the scope of embodiment but as merely providing illustrations of some of the presently preferred embodiments. For example, the table can have other shapes, such as oval, rectangular, octagonal, etc.; the elevating mechanism for each tabletop is not strictly limited to the details of the presently preferred embodiments; the table and all embodied parts are not limited in any way to any particular size, number of lifting mechanisms beneath each tabletop, the mechanical operation and design of said lifting mechanisms, construction materials used, etc.

Thus the scope of the embodiment should be determined by the appended claims and their legal equivalents, rather than by the examples given.

I claim:

1. A table, comprising:

(a) a primary tabletop, (b) means for supporting said primary tabletop horizontally, (c) a second tabletop vertically nested within and horizontally surrounded by said primary tabletop, (d) one or more additional tabletops vertically nested within and horizontally surrounded by any tabletop located inside the horizontal perimeter of said primary and second tabletops, (e) a unified contiguous horizontal tabletop surface formed from the adjoining tabletop surfaces of said primary and second tabletops and said additional nested tabletops, (f) means for independently vertically erecting and horizontally supporting any nested tabletop at an elevated height relative to the height of the tabletop immediately horizontally surrounding said nested tabletop wherein said means for independently vertically erecting and horizontally supporting any nested tabletop at an elevated height relative to the height of the tabletop immediately horizontally surrounding said nested tabletop includes a plurality of rigid collapsible supporting members which are physically and pivotally connected to both the underside of said nesting tabletop and the underside of said tabletop immediately horizontally surrounding said nested tabletop.

* * * * *